US005499747A

United States Patent [19]

Quennessen

[11] Patent Number: 5,499,747

[45] Date of Patent: Mar. 19, 1996

[54] RETRACTABLE CARRIER FOR, AND IN COMBINATION WITH, A VIAL-TYPE FLUID DISPENSER

[76] Inventor: Bernard R. Quennessen, Qualipac Corporation, 130 Algonquin Pkwy., Whippany, N.J. 07470

[21] Appl. No.: 243,217

[22] Filed: May 16, 1994

[51] Int. Cl.[6] ..... B67D 5/64; B65D 85/20

[52] U.S. Cl. ..... 222/167; 222/182; 206/446; 132/320; 401/116

[58] Field of Search ..... 206/446, 525, 206/385; 222/160, 183, 182, 131, 167, 168, 394, 559; 132/320, 318; 401/78, 116

[56] References Cited

U.S. PATENT DOCUMENTS

| | | | |
|---|---|---|---|
| 2,756,105 | 7/1956 | Magill | 206/446 X |
| 2,896,778 | 7/1959 | Hopgood | 401/78 |
| 2,998,165 | 8/1961 | De Elorza | 222/182 |
| 3,254,803 | 6/1966 | Meshberg | 222/182 |
| 3,309,728 | 3/1967 | Seever | 401/116 X |
| 3,450,299 | 6/1969 | La Barbera | 222/182 X |
| 3,540,628 | 11/1970 | Trosch | 222/183 |
| 3,623,822 | 11/1971 | Davidson | 401/78 |
| 3,991,777 | 11/1976 | Powers et al. | 132/320 |
| 4,180,163 | 12/1979 | Grioni | 206/385 |
| 4,676,408 | 6/1987 | Speitel | 222/183 |

*Primary Examiner*—Bryon P. Gehman
*Attorney, Agent, or Firm*—Bernard J. Murphy

[57] ABSTRACT

A cylindrical base slidably receives a sleeve which has spiral trackways formed therein. Pins projecting from the base, into the trackways, cause the sleeve to rise through the base, and to project outwardly from the base, when an apertured cap, which is coupled to the base, and the base are rotated therebetween. The sleeve receives a vial of fluid (viz.: perfume) which has an atomizing cap. Consequently, with elevation of the sleeve, through the base, the atomizing cap of the vial is exposed for operation. A reverse rotation causes the vial and sleeve to retract into the base, and the atomizing cap sealingly closes off the aperture of the carrier.

13 Claims, 2 Drawing Sheets

FIG. 1
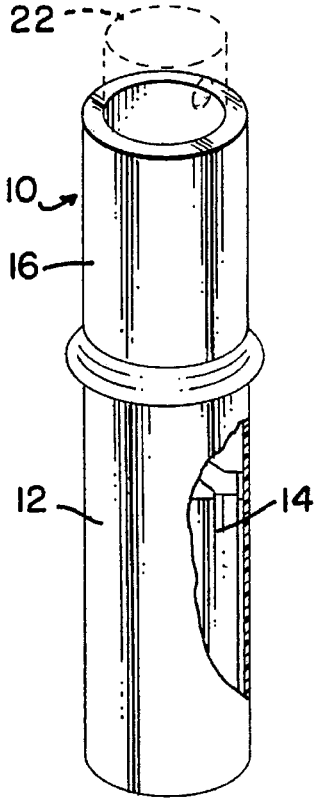
FIG. 2
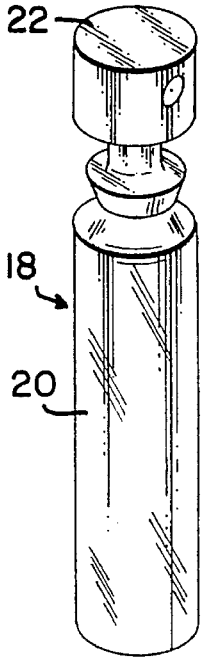
FIG. 5
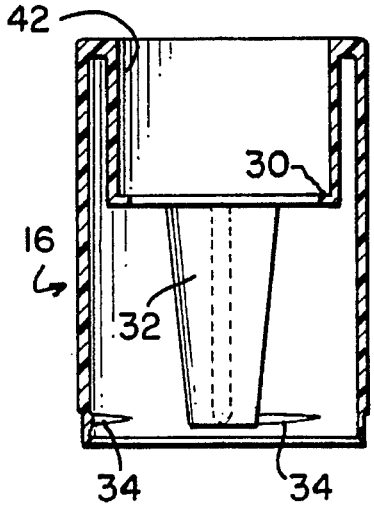
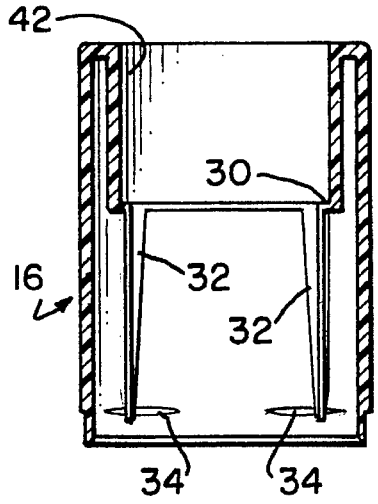
FIG. 6
FIG. 4
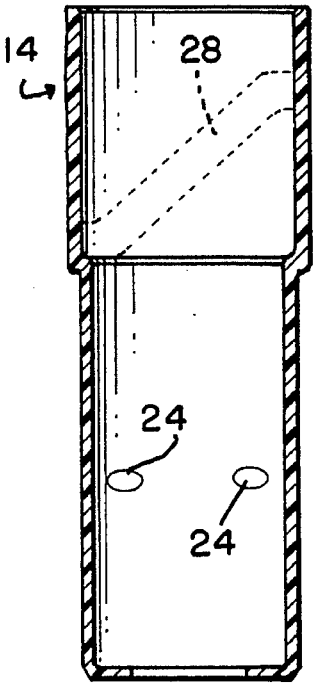
FIG. 3
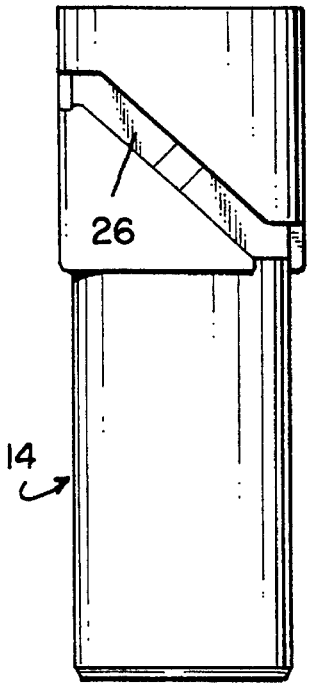

RETRACTABLE CARRIER FOR, AND IN COMBINATION WITH, A VIAL-TYPE FLUID DISPENSER

This invention pertains to accessories, such as lipstick dispensers, perfume dispensers, compacts, breath sweetners, and the like, and in particular to a retractable carrier for, and in combination with, a vial-type fluid dispenser.

Already known, in the prior art, are retractable carriers for lipsticks, and exemplary thereof are U.S. Pat. Nos. 1,863,106; 4,815,485; and 4,917,133; issued on 14 Jun. 1932, Mar. 28th 1989, and 17 Apr. 1990, respectively. Such lipstick retractable carriers commonly have a lipstick secured in the carrier, irremovably, and closed with a cylindrical cap which covers the exposed end of the lipstick. There are occasions, however, when one will want to carry a vial of perfume, with an atomizing cap thereon, or a vial of atomizable medicine, or breath freshener, or the like. Such of these as are known, of course, have a cap closure therefor to insure that, when carried in a pocket or purse, they will not be inadvertently discharged. Therefore, as with the commonly known lipstick, in a retractable carrier, they must be withdrawn from the pocket or purse, the cap must be removed, then the lipstick or dispenser can be operated. Thereafter, the cap must be replaced, not only to prevent unadvertent discharge of such atomizable fluid as may be involved, but in the case of lipstick, to keep detritus from entering the carrier.

There has been a long-standing need for a retractable carrier for vial-type fluid dispensers which are (a) secure against discharge in a purse or pocket, and (b) operative without having to remove a closure cap therefor.

It is an object of this invention, then, to set forth a retractable carrier for a vial-type fluid dispenser, and in combination with such a dispenser, which meets the aforesaid need in an efficient and facile manner.

Particularly, it is an object of this invention to disclose a retractable carrier, for a vial-type fluid dispenser, comprising a cylindrical base; a sleeve slidably disposed in said base; and a tubular cap; wherein said base has one open end; said end has an annular trough formed therein; said cap has a terminal end which releasably nests, with a frictional engagement, in said trough; and said base, said sleeve, and said cap have means mutually cooperative for causing said sleeve to translate, through said base, in response to a relative rotation between said base and said cap.

It is a further object of this invention to set forth, in combination, a vial-type fluid dispenser and a retractable carrier therefor, comprising a cylindrical base; and a sleeve slidably disposed in said base; wherein said sleeve has means formed therewithin for detentingly restraining a vial-type fluid dispenser from removal therefrom; and a vial-type fluid dispenser confined within said sleeve; a tubular cap; wherein said base has one open end; said end has an annular trough formed therein; said cap has a terminal end which releasably nests, with a frictional engagement, in said trough; said cap has a rimmed orifice at the opposite end thereof; said dispenser has an outermost end which closes off said orifice; and said base, said sleeve, and said cap have means mutually cooperative for causing said sleeve (a) to translate, through said base, in response to a relative rotation between said base and said cap, and (b) to elevate said outermost end of said dispenser through said rimmed orifice.

Further objects of this invention, as well as the novel features thereof will become apparent by reference to the following description, taken in conjunction with the accompanying figures, in which:

FIG. 1 is a perspective illustration of the novel carrier, shown in combination with a vial-type, atomizing dispenser for fluid, the base of the carrier being partly cut away to disclose the sleeve therewithin, and in phantom, the operative cap of the dispenser is shown elevated and ready for use;

FIG. 2 is a perspective illustration of the vial-type dispenser of FIG. 1;

FIG. 3 is an elevational view of the sleeve;

FIG. 4 is an axial cross-sectional view of the sleeve of FIG. 3;

FIGS. 5 and 6 are cross-sectional, axial views of the cap, the two being rotated ninety degrees of arc apart;

Figure 7:
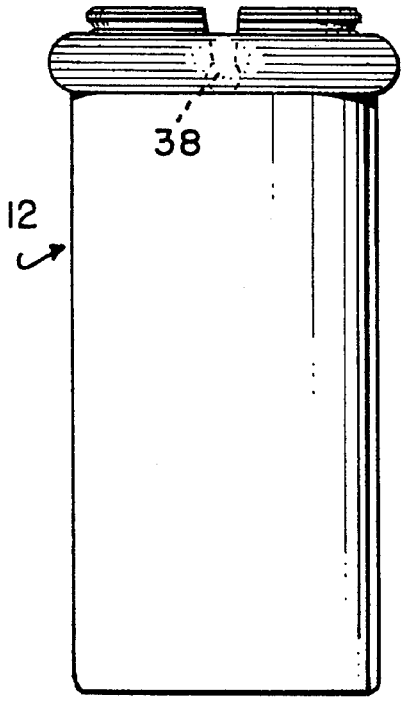
FIG. 7 is an elevational view of the base.

As shown in FIG. 1, the novel carrier 10 for a vial-type fluid dispenser comprises a base 12, a sleeve 14 confined within the base, and a cap 16 set atop the base 12. The carrier 10 accommodates therewithin a vial-type fluid dispenser, the atomizing cap of which is shown, only in phantom, in FIG. 1. FIG. 2 illustrates the dispenser 18, the same having a glass reservoir 20 in which to confine a fluid and a fluid-conveying conduit (not shown), and an atomizing cap 22.

FIGS. 3 and 4 depict the sleeve 14. It has three nubs 24 (only two thereof being visible) equally spaced apart within the sleeve 14 for detentingly engaging the glass reservoir 20 and restraining a removal of the dispenser 18 therefrom. In addition, the sleeve 14 has a pair of spiraling trackways 26 and 28 formed therein.

The cap 16 is shown, in cross-sections, in FIGS. 5 and 6, where it can be seen there is an annular shoulder 30 formed therein. The shoulder 30 is so dimensioned that it defines a limit stop for the atomizing cap 22 of the dispenser 18, when the dispenser is retracted in the carrier. By this means, it becomes impossible to operate the atomizing cap 22, to effect a dispensing of the fluid confined in the reservoir 20, with the dispenser so retracted. In addition, the cap has a pair of depending limbs 32 which set astride the sleeve 14 to guide it in its translation. Further, minute, circumferentially disposed lobes 34, formed on the inner surface of the cap 16 near the pendent ends of the limbs 32, aid in frictionally clasping the uppermost end of the base 12

Figure 8:
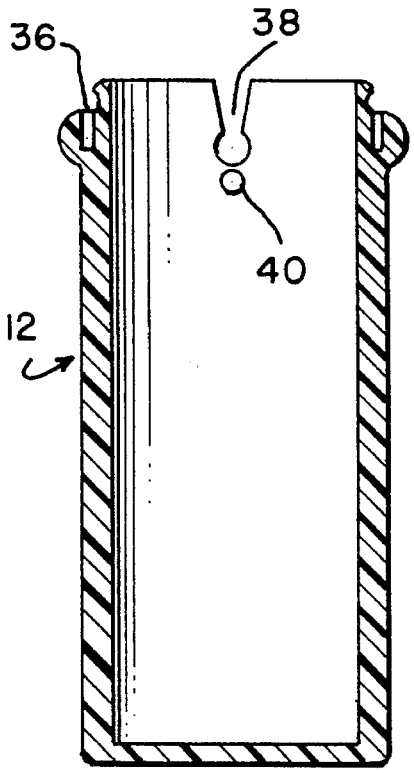
FIG. 8 is an axial cross-section of the base.

The base 12, shown in FIGS. 7 and 8, is of cylindrical form, and is closed at one end. At the opposite, upper end thereof the base has an annular trough 36. The base 12, further, has a pair of slots 38 formed in the trough end thereof, and in immediate adjacency to the slots 38 are a pair of inwardly extending pins 40. The pins 40 are provided for slidably engaging the trackways 26 and 28 of the sleeve 14, and the slots 38 are locating means for identifying whereat the pins 40 are sited.

On assembly, the lowermost ends of the trackways 26 and 28 are aligned with the slots 38, in order that the pins 40 will engage the trackways intrusively. The sleeve is then rotated to cause it to retract fully into the base 12. Next, the dispenser 18 is set into the cap 16, via the bottom thereof, and the cap 22 is set against the shoulder 30. The uppermost end of the cap 16 comprises a rimmed orifice 42 and the top of the atomizing cap 22 of the dispenser defines a closure for the orifice.

Figure 9:
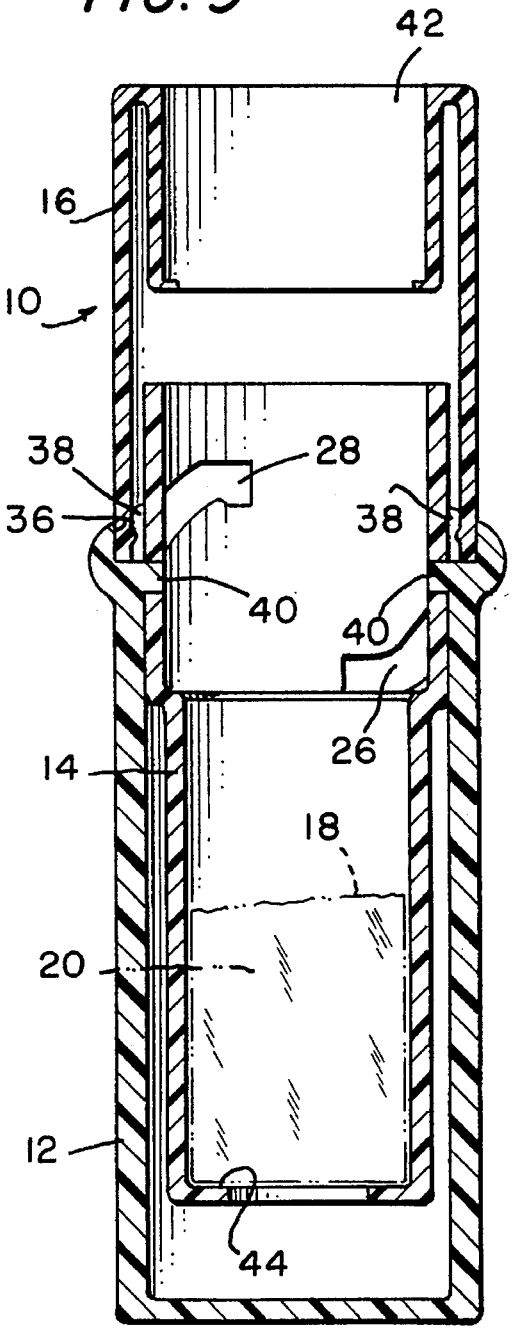
FIG. 9 is an axial, cross-sectional illustration depicting the sleeve in the base, with the pins engaged with the trackways, the cap nested in the trough of the sleeve, and a phantomed, fragmentary portion of the vial-type dispenser.

The depending glass reservoir 20 is then inserted into the sleeve 14 (in the base 12), and set onto the bearing surface 44 defined by the bottom of the sleeve 14, and the lobed end of the cap 16 is pressed into the trough 36 for frictionally engaging the uppermost end of the base 12 as shown in FIG. 9.

Now assembled, when the base 12 is held and the cap 16 rotated, the pins 40 will negotiate the trackways 26 and 28 and, consequently, cause the dispenser 18, carried by the sleeve 14, to rise with the sleeve until the atomizing cap 22 projects above the rimmed orifice 42. So disposed, the atomizing cap 22 can be depressed to cause an emission of fluid from the reservoir 20. Then, again, by holding the base and rotating the cap 16 again, in the reverse direction, the atomizing cap 22 will disappear within the cap 16 and come to a stop against the shoulder 30. Too, the top of the atomizing cap 22 closes off the orifice 42, inhibiting the entry therethrough of any extraneous matter, and defining of the carrier 10 a compact, self-contained and attractive article.

While the invention has been described in connection with a specific embodiment thereof it is to be clearly understood that this is done only by way of example, and not as a limitation to the scope of the invention as set forth in the objects thereof and in the appended claims. As described herein, the pins 40 project from the inside of the base 12, and the trackways are formed in the sleeve 14. If desired, the arrangement can just as readily be reversed, with trackways 26 and 28 formed within the base 12 and the pins 40 projecting outwardly from the sleeve 14 for trackway engagement. This, and all other modifications or differing embodiments of the invention, as will occur to others by taking teaching from our disclosure herein, are deemed to be within the ambit of the invention and embraced by the claims.

I claim:

1. A retractable carrier, for a fluid dispenser, comprising:

a cylindrical base;

a sleeve slidably disposed in said base; and a tubular cap; wherein said base has one open end;

said end has an annular trough formed therein;

said cap has a terminal end which releasably nests, with a frictional engagement, in said trough; and said base, said sleeve, and said cap have means mutually cooperative for causing said sleeve to translate through said base in response to a relative rotation between said base and said cap; and wherein said means comprises at least one trackway formed in said sleeve, and a pin extending inwardly from said base and intrusively in one said trackway.

2. A retractable carrier, according to claim 1, wherein:

said sleeve comprises means for removably confining a dispenser therein.

3. A retractable carrier, according to claim 1, wherein:

said sleeve is open at one end, and closed at the opposite end; and said opposite end of said sleeve comprises a bearing surface for a fluid dispenser.

4. A retractable carrier, according to claim 3, wherein:

said sleeve has means therewithin for detentingly restraining removal of a fluid dispenser therewithin.

5. A retractable carrier, according to claim 4, wherein:

said removal restraining means comprises at least one nub formed within said sleeve.

6. A retractable carrier, according to claim 1, wherein:

said cap has a pair of depending limbs therewithin; and said limbs comprise means for setting astride the sleeve and guiding the sleeve in translation thereof within said base.

7. A retractable carrier, for a fluid dispenser, comprising:

a cylindrical base;

a sleeve slidably disposed in said base; and a tubular cap; wherein said base has one open end;

said end has an annular trough formed herein;

said cap has a terminal end which releasably nests, with a frictional engagement, in said trough; and said base, said sleeve, and said cap have means mutually cooperative for causing said sleeve to translate through said base in response to a relative rotation between said base and said cap; and wherein said means comprises a pair of separate, spirally-formed trackways formed in an outer surface of said sleeve, and a pair of pins, integral with, and extending inwardly of said base, in penetration of said trackways.

8. A retractable carrier, according to claim 7, wherein:

said end of said base has shallow slots formed therein on opposite sides thereof; and said pins are formed in said base in immediate adjacency to innermost ends of said slots.

9. In combination, a fluid dispenser and a retractable carrier therefor, comprising:

a cylindrical base; and a sleeve slidably disposed in said base; wherein said sleeve has means formed therewithin for detentingly restraining a fluid dispenser from removal therefrom; and a fluid dispenser confined within said sleeve;

a tubular cap; wherein said base has one open end;

said end has an annular trough formed therein;

said cap has a terminal end which releasably nests, with a frictional engagement, in said trough;

said cap has a rimmed orifice at the opposite end thereof;

said dispenser has an outermost end which closes off said orifice; and said base, said sleeve, and said cap have means mutually cooperative for causing said sleeve (a) to translate through said base in response to a relative rotation between said base and said cap, and (b) elevate said outermost end of said dispenser through said rimmed orifice.

10. The combination, according to claim 9, wherein:

said dispenser has an operating cap; and said tubular cap has means therewithin for preventing operation of said operating cap of said dispenser.

11. The combination, according to claim 10, wherein:

said operation preventing means comprises a limit stop formed within said tubular cap for engagement thereof by a lowermost portion of said operating cap.

12. The combination, according to claim 11, wherein:

said limit stop comprises an annular shoulder formed within said tubular cap.

13. In combination, a fluid dispenser and a retractable carrier therefor, comprising:

a cylindrical base;

a sleeve slidably disposed in said base; and a fluid dispenser confined within said sleeve; wherein said dispenser is removably engaged with said sleeve; and a tubular cap coupled to said base; wherein said cap has a rimmed orifice formed in an end thereof;

said dispenser has an outermost end which closes off said orifice; and said base and said sleeve have means mutually cooperative for causing, said sleeve (a) to translate through said base, and (b) to elevate said dispenser and raise said outermost end thereof through said orifice.

* * * * *